US008523640B2

(12) United States Patent
Esenwein

(10) Patent No.: US 8,523,640 B2
(45) Date of Patent: Sep. 3, 2013

(54) GUARD HOOD TORSION PREVENTER

(75) Inventor: Florian Esenwein, Uhingen-Holzhausen (DE)

(73) Assignee: Robert Bosch GmbH, Stuttgart (DE)

( * ) Notice: Subject to any disclaimer, the term of this patent is extended or adjusted under 35 U.S.C. 154(b) by 919 days.

(21) Appl. No.: 12/498,780

(22) Filed: Jul. 7, 2009

(65) Prior Publication Data

US 2010/0105300 A1 Apr. 29, 2010

(30) Foreign Application Priority Data

Jul. 11, 2008 (DE) ..... 10 2008 040 372

(51) Int. Cl.
*B24B 55/04* (2006.01)

(52) U.S. Cl.
USPC ..... 451/451; 451/359; 451/452

(58) Field of Classification Search
USPC ..... 451/344, 359, 451, 452, 453, 454
See application file for complete search history.

(56) References Cited

U.S. PATENT DOCUMENTS

| | | | | |
|---|---|---|---|---|
| 4,060,940 | A * | 12/1977 | DeWitt | 451/358 |
| 4,574,532 | A * | 3/1986 | Haberle et al. | 451/451 |
| 4,791,541 | A * | 12/1988 | Simmons | 362/376 |
| 4,924,635 | A * | 5/1990 | Rudolf et al. | 451/344 |
| 5,005,321 | A * | 4/1991 | Barth et al. | 451/359 |
| 5,074,044 | A * | 12/1991 | Duncan et al. | 30/124 |
| 5,163,252 | A | 11/1992 | Garner et al. | |
| 5,384,985 | A * | 1/1995 | Jacobsson | 451/344 |
| 5,440,815 | A * | 8/1995 | Inkster | 30/390 |
| 5,766,062 | A * | 6/1998 | Edling | 451/451 |
| 6,464,573 | B1 * | 10/2002 | Keller | 451/451 |
| 6,669,544 | B1 * | 12/2003 | Walz et al. | 451/454 |
| 6,699,114 | B1 * | 3/2004 | Booeshaghi et al. | 451/451 |
| 6,893,334 | B1 * | 5/2005 | Stivers | 451/359 |
| 6,949,017 | B2 * | 9/2005 | Koschel et al. | 451/358 |
| 6,988,939 | B2 * | 1/2006 | Hofmann et al. | 451/344 |
| 7,063,606 | B2 * | 6/2006 | Stierle et al. | 451/359 |
| 7,089,671 | B2 * | 8/2006 | Haneda et al. | 30/391 |
| 7,311,589 | B2 * | 12/2007 | Wiker | 451/451 |
| 7,524,239 | B2 * | 4/2009 | Schmidberger-Brinek et al. | 451/451 |
| 2002/0157265 | A1 * | 10/2002 | Haneda et al. | 30/391 |
| 2004/0014412 | A1 * | 1/2004 | Hofmann et al. | 451/451 |
| 2006/0052041 | A1 * | 3/2006 | Wiker | 451/451 |
| 2008/0153404 | A1 * | 6/2008 | Schmidberger-Brinek et al. | 451/359 |

FOREIGN PATENT DOCUMENTS

| | | | |
|---|---|---|---|
| CN | 1852785 | A | 10/2006 |
| CN | 101157196 | A | 4/2008 |
| DE | 101 15 635 | C1 | 10/2002 |
| DE | 102007034603 | A1 | 1/2009 |
| WO | 2007/059604 | A1 | 5/2007 |
| WO | 2008/058797 | A1 | 5/2008 |

* cited by examiner

*Primary Examiner* — Eileen P. Morgan
(74) *Attorney, Agent, or Firm* — Maginot, Moore & Beck

(57) ABSTRACT

The invention is based on a guard hood torsion preventer for a handheld power tool, in particular for a right-angle power sander. The invention is for preventing torsion of a guard hood on the handheld power tool, in particular in the event of damage to a tool. The guard hood torsion preventer includes at least one torsion-prevention unit which has a longitudinal axis, about which the torsion-prevention unit is rotatably supported.

16 Claims, 7 Drawing Sheets

GUARD HOOD TORSION PREVENTER

CROSS-REFERENCE TO RELATE APPLICATION

This application is based on German Patent Application 10 2008 040 372.5 filed Jul. 11, 2008.

BACKGROUND OF THE INVENTION

1. Field of the Invention

The invention is based on a guard hood torsion preventer.

2. Description of the Prior Art

A guard hood torsion preventer for a right-angle power sander is already known that is intended for preventing torsion of a guard hood on the handheld power tool in the event of damage to a tool.

OBJECT AND SUMMARY OF THE INVENTION

The invention is based on a guard hood torsion preventer for a handheld power tool, in particular for a right-angle power sander, which is intended for preventing torsion of a guard hood on the handheld power tool, in particular in the event of damage to a tool, of a guard hood on the handheld power tool, in particular in the event of damage to a tool, having at least one torsion-prevention unit.

It is proposed that the torsion-prevention unit has a longitudinal axis, about which the torsion-prevention unit is rotatably supported. In this connection, the term "intended" should be understood in particular to mean especially equipped and/or especially designed. Moreover, the term "damage to a tool" should be understood in particular to mean a tool that bursts during operation of the handheld power tool, where individual pieces of the tool are spun outward because of a rotation of the tool. The term "preventing torsion" or "torsion prevention" should furthermore mean securing against unwanted torsion, particularly in the event of damage to a tool, of a guard hood unit out of its guard position relative to a handheld power tool, so that the guard hood always remains in a guard position that is advantageous for a user. Preferably, the guard hood together with the guard hood torsion preventer is designed so that in the event of a bursting tool, the guard hood is rotated, in response to transmission of an linear momentum from a fragment of a burst tool that has spun outward onto the guard hood, the guard hood is rotated by a maximum of 90°, and the user is shielded from the tool fragments by the guard hood, and in particular energy of the tool fragments is dissipated by the guard hood and/or by the guard hood torsion preventer while preserving a guard function for the user, and/or the tool fragments are conducted in a direction leading away from the user. The term "longitudinal axis" should also be understood in particular to mean an axis along a lengthwise direction and/or a primary direction in which the torsion-prevention unit extends. Preferably, the longitudinal axis is oriented essentially perpendicular to an axis of rotation of a tool. Advantageously, the torsion-prevention unit is intended in at least one position for securing, and in particular preventing rotation of, the guard hood. By means of the design according to the invention, advantageous protection of a user in a mode of operation of the handheld power tool, in particular the right-angle power sander, against tool fragments flying around and in particular being spun outward by a force of rotation, is achieved in the event of a bursting tool, and in particular the guard hood can advantageously be kept in a guarding position.

It is furthermore proposed that the guard hood torsion preventer has at least one bearing point, by means of which the torsion-prevention unit is braced on the handheld power tool. Preferably, the bearing point is secured or braced directly on a housing and/or a receiving unit for receiving a tool, such as a receiving flange. By means of this design, an advantageous, and in particular secure, fastening of the torsion-prevention unit can be attained via the bearing point, which is intended for secure bracing of the guard hood along with the torsion-prevention unit in the presence of strong forces and/or torques acting on the torsion-prevention unit, as in the case for example of a bursting tool.

In an embodiment of the invention, it is proposed that the torsion-prevention unit has at least one shaft, as a result of which a space-saving torsion-preventing motion can be attained, such as a rotation of the shaft, in particular about the longitudinal axis, in the torsion-prevention unit. The shaft is preferably formed by a force-locking shaft or a form-locking shaft.

It is furthermore proposed that the torsion-prevention unit is intended, by means of a rotation about its longitudinal axis, for varying the guard hood in its position. The term "varying a position" should be understood to mean in particular that for positioning when mounting of the guard hood, a plurality of different guarding positions are available, and the guard hood can be changed from one guarding position to a further guarding position upon a rotation of the torsion-prevention unit about its longitudinal axis. A change from one guarding position to a further guarding position can especially advantageously be effected in a continuously variable manner. An advantageous adaptation of the guard hood, and in particular of a guarding position of the guard hood, to a work situation, particularly by a user, can be achieved and hence a high degree of protection, in particular individual protection, for the user can be attained.

If the torsion-prevention unit has at least one actuation element that is intended for rotating the torsion-prevention unit about its longitudinal axis, then advantageously a position can be adapted to a work situation by means of a change of position of the guard hood performed by a user, and thus a high degree of user comfort and convenience can be attained. The actuation element is preferably designed for operation by a user of the handheld power tool. An especially space-saving embodiment of the actuation element can be attained if the actuation element is formed by a set screw. In principle, in an alternative embodiment of the invention, the actuation element can also be formed by a switch element that can be operated by a user, by which element a motor for rotating the torsion-prevention unit can be controlled, and/or can be formed by a further actuation element that appears useful to one skilled in the art, such as a crank, rotary knob, and so forth.

It is furthermore proposed that the torsion-prevention unit is formed at least partly by a form-locking unit, as a result of which structurally simple torsion prevention, particularly of the guard hood in a guarding position, can be attained during operation of the right-angle power sander.

Especially advantageous torsion prevention of the guard hood when mounted in a guarding position on the power tool can be attained if the torsion-prevention unit is formed at least partly by a set of teeth. The term "set of teeth" should be understood in particular to mean a component and/or element that because of its shape is intended for transmitting a force and/or torque and in the process engages a further, complementary component and/or element.

In a further embodiment of the invention, it is proposed that the torsion-prevention unit is formed at least partly by a rolling-contact worm gear. In this connection, the term "rolling-contact worm gear" should in particular be understood to mean a gear which has at least one worm shaft and/or threaded shaft for transmitting and/or converting a force and/or a torque, and axes of rotation of transmission elements of the rolling-contact worm gear, which transmit a force and/or a torque to one another, are disposed such that they are rotated, in particular skewed, by approximately 90° relative to one another. Structurally simple securing of the guard hood in a guarding position can be attained because it is advantageously possible to use self-locking of the rolling-contact worm gear in at least one direction of rotation for securing the guard hood against torsion. Additional securing elements for securing the guarding position of the guard hood, such as a detent element or other securing elements that appear appropriate to one skilled in the art, are conceivable at any time in an alternative embodiment. Especially advantageously, the torsion-prevention unit has at least one threaded shaft.

It is furthermore proposed that the torsion-prevention unit is formed at least partly by a force-locking unit, as a result of which a torsion-prevention unit can be attained that is economical in terms of material and in particular is inexpensive.

In an advantageous refinement of the invention, it is proposed that at least one further torsion-prevention unit and a guard hood, the torsion-prevention unit having at least two torsion-prevention elements, which are disposed in succession in a circumferential direction on the guard hood. In this connection, the term "disposed" should be understood in particular to mean that the torsion-prevention elements are secured directly on the guard hood and/or a force of gravity of the torsion-prevention elements is braced via the guard hood. Furthermore, the torsion-prevention elements may also be embodied in one piece with the guard hood, the term "in one piece" being understood to mean in particular one-piece and/or made in one casting and/or embodied as a single component. Moreover, the term "circumferential direction" should be understood in particular to mean a direction which extends around the guard hood in a longitudinal direction of a neck of the guard hood and/or in a mounted state of the guard hood extends about an axis of rotation of a tool. The torsion-prevention elements may be formed by form-locking elements and/or force-locking elements. By the embodiment according to the invention, structurally simple securing of the guard hood in a guarding position can advantageously be attained. Moreover, a flow of force and/or torque transmitted to the guard hood can advantageously be dissipated by way of a plurality of torsion-prevention elements, so that even if strong torques and/or linear momentums are operative on the guard hood, especially in the case of a tool that bursts during operation of the right-angle power sander, securing of the guard hood in a guarding position can be provided.

Especially advantageously, at least one of the torsion-prevention elements is formed at least partly by a set of teeth, so that especially secure prevention of torsion of the guard hood in operation of the handheld power tool can be attained. Advantageously, the torsion-prevention elements or the set of teeth forms a contrary contour to a set of teeth that is braced and/or supported on a housing and/or a receiving unit of the right-angle power sander. In principle, the form-locking element, in an alternative embodiment of the invention, can also be formed by a recess and/or further form-locking elements, which appear useful to one skilled in the art, and/or the torsion-prevention unit can be formed by a force-locking unit.

Furthermore, it is proposed that the torsion-prevention unit is disposed at least partly on a side of the guard hood facing away from a receiving region of the guard hood for a tool and/or on a side of the guard hood facing away from a receiving region of the guard hood for fastening. In this connection, the term "receiving region of the guard hood for a tool" should be understood in particular to mean a region of the guard hood that is intended for receiving a tool, where the guard hood, in particular a disklike guard hood body, shields the user from the tool receiving region. Moreover, the term "receiving region of the guard hood for fastening" should be understood in particular to mean a region of the guard hood that is surrounded by a guard hood neck and/or a tightening strap and that is intended for receiving a receiving flange of the right-angle power sander. An especially space-saving disposition of the torsion-prevention unit on the guard hood can be attained here, and moreover an advantageously large securing area for the torsion-prevention unit in the event of damage to the tool.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
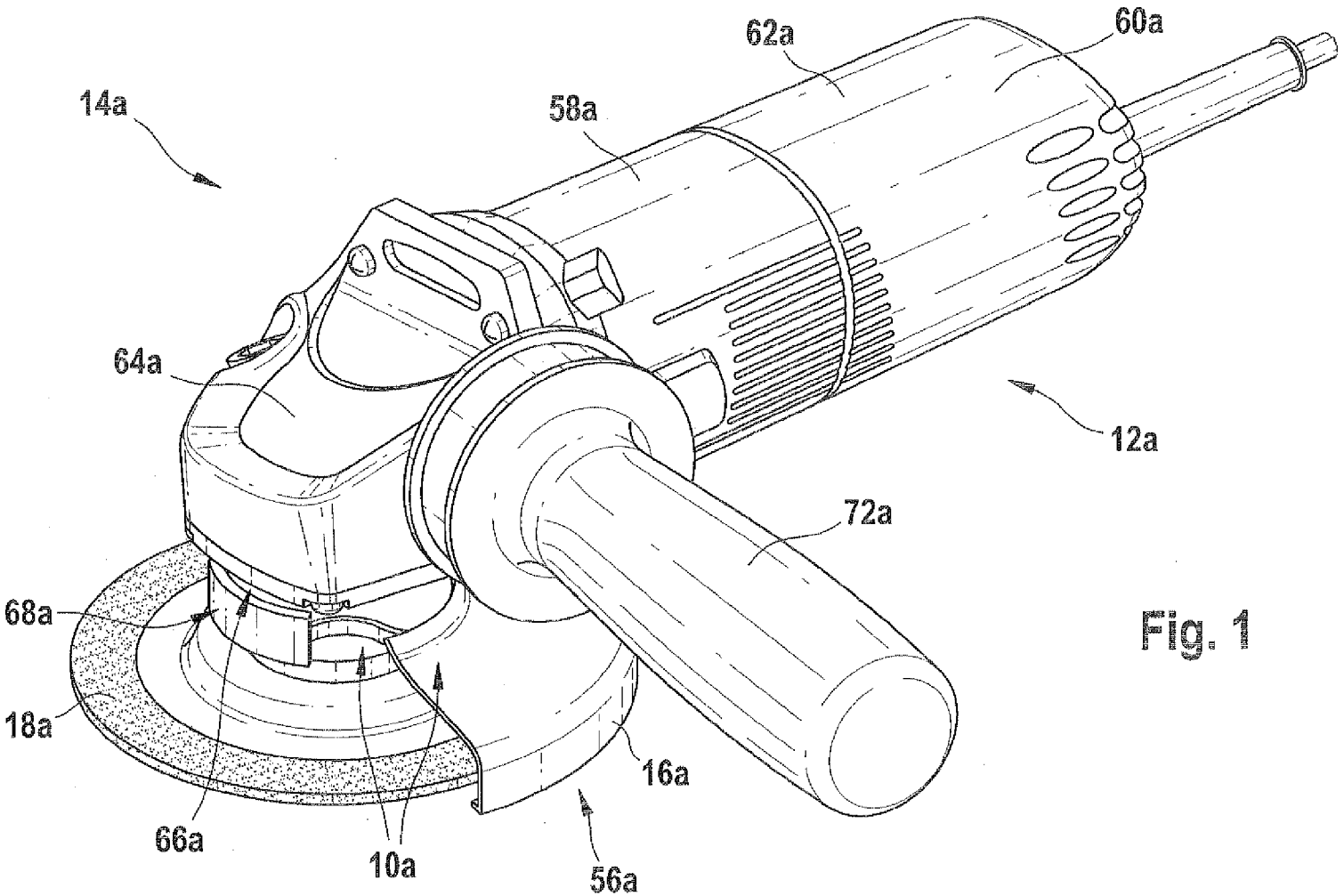
FIG. 1 shows a right-angle power sander, having a guard hood torsion preventer according to the invention, in a schematic illustration.

In FIG. 1, a handheld power tool 12*a*, formed by a right-angle power sander 14*a*, is shown, along with a guard hood unit 56*a* and a guard hood torsion preventer 10*a*. The right-angle power sander 14*a* includes a handheld power tool housing 58*a* and a primary hand grip 60*a* that is integrated with the handheld power tool housing 58*a*. The handheld power tool housing 58*a* includes a motor housing 62*a* and a gearbox 64*a*. The right-angle power sander 14*a* also has a receiving unit 66*a*, for receiving the guard hood unit 56*a* or a tool 18*a* fowled by a cutting disk, and the receiving unit is screwed to the handheld power tool housing 58*a*. The guard hood unit 56*a* includes a guard hood 16*a* and a locking unit 68*a*. The guard hood 16*a*, in a mounted state, covers an angular range of approximately 180° of the tool 18*a*. An additional hand grip 72*a* is disposed on the gearbox 64*a* of the right-angle power sander 14*a*. The guard hood torsion preventer 10*a* is intended for torsion prevention of the guard hood 16*a* on the right-angle power sander 14*a* to counter unwanted torsion of the guard hood 16*a*, in particular as in the case of a tool 18*a* that is bursting.

Figure 2:
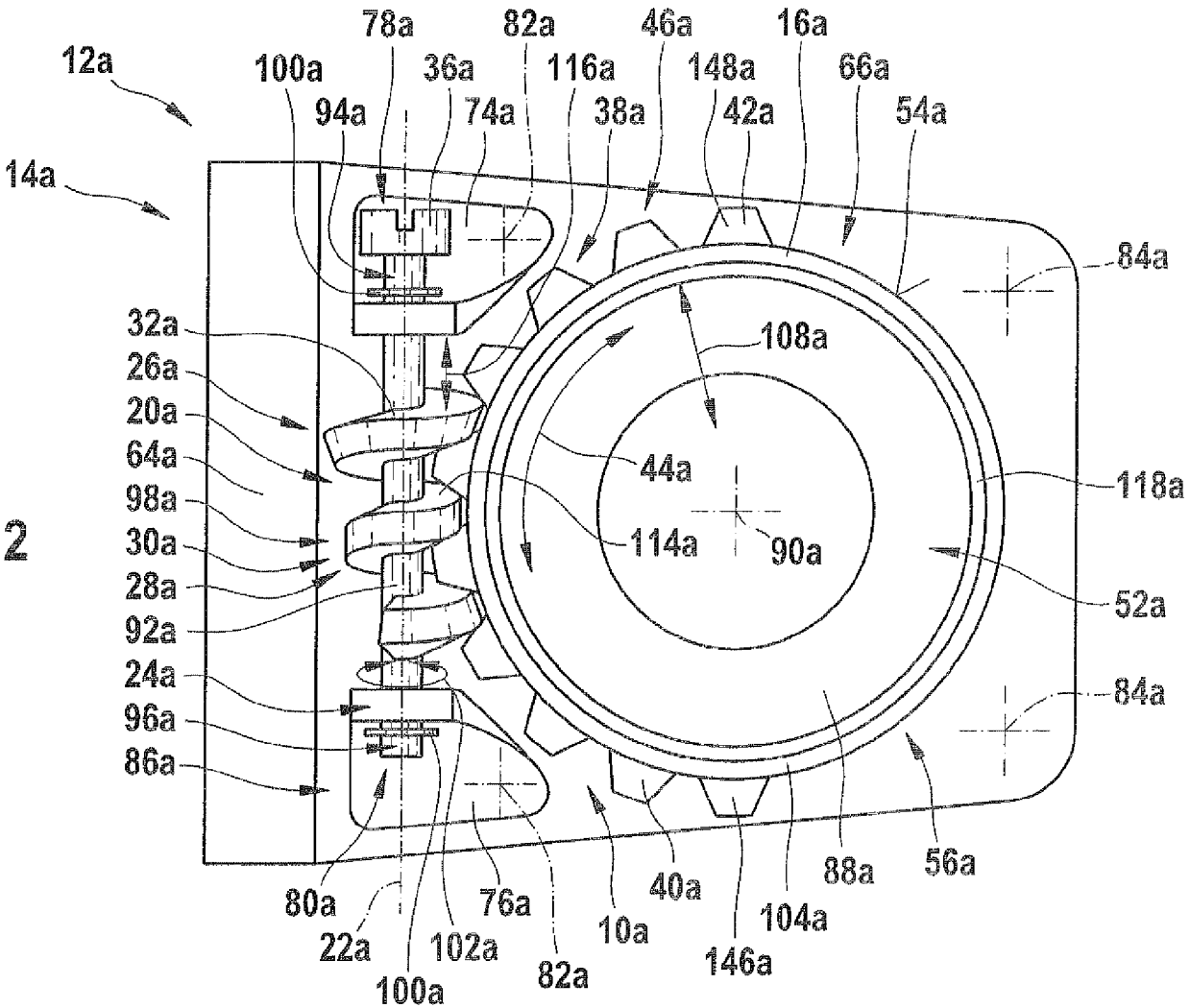
FIG. 2 shows the guard hood torsion preventer with a form-locking unit, in a schematic illustration.

In FIG. 2, the guard hood torsion preventer 10*a* of FIG. 1 is shown in greater detail. For the sake of simplicity, a guard hood of the guard hood unit 56*a* is not shown in FIG. 2. The guard hood torsion preventer 10*a* has two torsion-prevention units 20*a*, 38*a*. The first torsion-prevention unit 20*a* is braced or secured to the receiving unit 66*a* by means of a bearing point 24*a*. In principle, it is furthermore conceivable that the bearing point 24*a* is disposed or secured on the gearbox 64*a* and/or other housing components that appear appropriate to one skilled in the art. The first torsion-prevention unit 20*a* has a longitudinal axis 22*a*, about which the torsion-prevention unit 20*a* is rotatably secured by means of the bearing point 24*a*. The bearing point 24*a* has two bearing elements 74*a*, 76*a*, which are disposed along the longitudinal axis 22*a* on opposed end regions 78*a*, 80*a* of the first torsion-prevention unit 20*a* on the receiving unit 66*a*. The two bearing elements 74*a*, 76*a* are screwed to the receiving unit 66*a*, each via a respective screw connection 82*a*, and by means of the two screw connections 82*a* and two further screw connections 84*a*, the receiving unit 66*a* is secured to the gearbox 64*a*. The torsion-prevention unit 20*a* is disposed on a region 86*a*, oriented toward the gearbox 64*a*, of the receiving unit 66*a* next to a flange neck 88*a* for fastening the tool 18*a* and the guard hood unit 56*a*. The longitudinal axis 22*a* is embodied essentially transversely to an axis of rotation 90*a* of a drive shaft of the right-angle power sander 14*a* for driving the tool 18*a*.

The torsion-prevention unit 20*a* is formed by a form-locking unit 26*a*, which is formed at least partly by a rolling-contact worm gear 30*a*. The torsion-prevention unit 20*a* furthermore has a shaft 92*a*, which is rotatably supported by its end regions 94*a*, 96*a* along the longitudinal axis 22*a* in the bearing elements 74*a*, 76*a*. Along the longitudinal axis 22*a*, in a middle region 98*a*, the shaft 92*a* has a threaded shaft 32*a*, embodied as a set of teeth 28*a*, which is intended for form locking to the second torsion-prevention unit 38*a*. The shaft 92*a* is supported by its end regions 94*a*, 96*a* in recesses of the bearing elements 74*a*, 76*a* that are formed as angular components, and the shaft 92*a* is supported immovably along the longitudinal axis 22*a* via two securing rings 100*a*, which are disposed fixedly on the end regions 94*a*, 96*a* of the shaft 92*a*. The torsion-prevention unit 20*a* furthermore has an actuation element 36*a*, which is embodied in one piece with the shaft 92*a* and is disposed on one of the two end regions 94*a*, 96*a* of the shaft 92*a*. The actuation element 36*a* is embodied in the form of the head of a screw, so that for adjusting or rotating the torsion-prevention unit 20*a* in a direction of rotation 102*a* about the longitudinal axis 22*a*, this actuation element can be rotated or adjusted by a user using a screwdriver.

Figure 3:
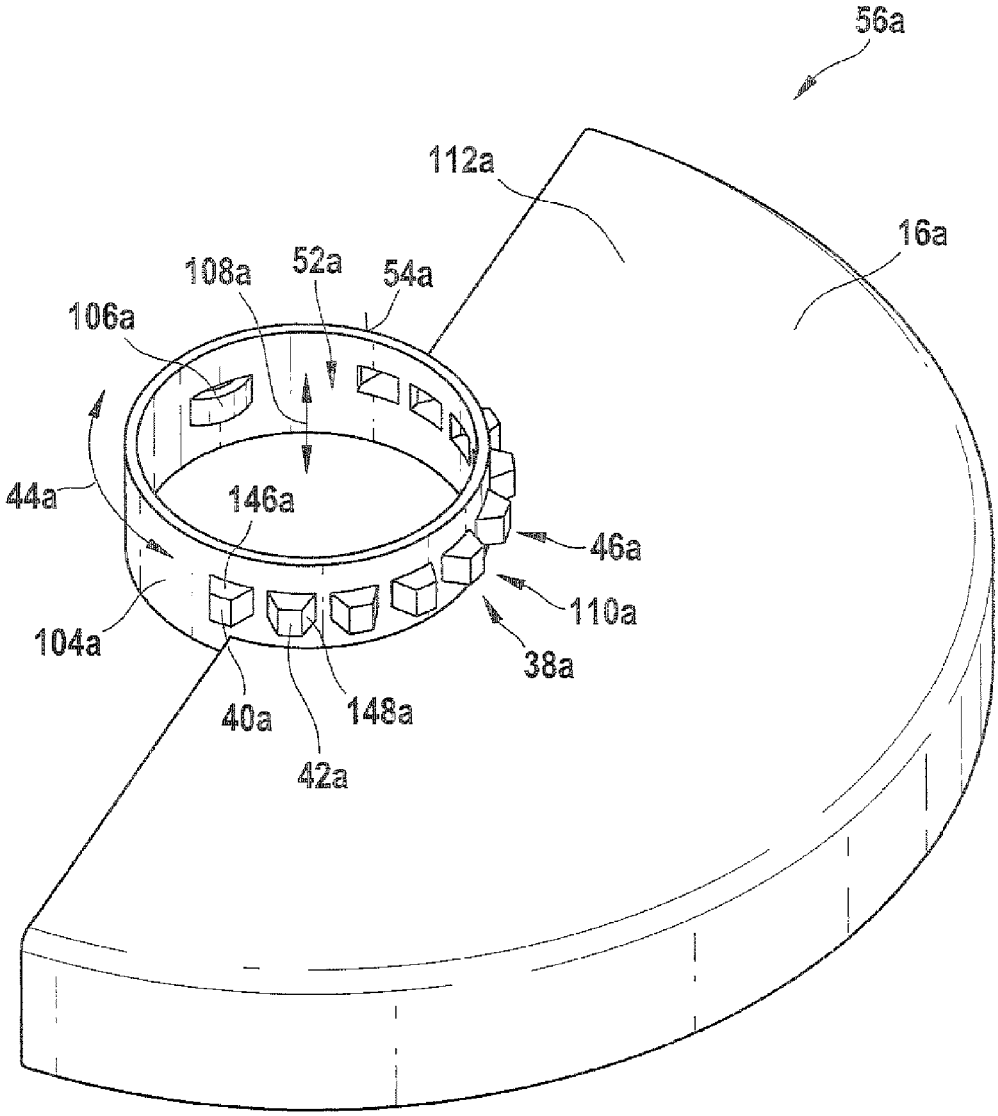
FIG. 3 shows a guard hood of the guard hood torsion preventer of FIG. 2 in a schematic illustration.

The guard hood torsion preventer 10*a* furthermore has the guard hood 16*a*, on which the second torsion-prevention unit 38*a* is disposed, and the torsion-prevention unit 38*a* is embodied in one piece with the guard hood 16*a* (see FIGS. 2 and 3). The guard hood 16*a* has a guard hood neck 104*a*, by means of which the guard hood 16*a* can be secured to the flange neck 88*a*. For that purpose, the guard hood neck 104*a* surrounds a receiving region 52*a* of the guard hood 16*a*. The guard hood neck 104*a* has a coding element 106*a*, which is formed by a coding lug oriented inward from the guard hood neck 104*a* in a radial direction 108*a* of the guard hood 16*a*. The coding element 106*a*, together with a coding element, not shown in further detail, of the flange neck 88*a*, is intended for preventing the mounting of the guard hood unit 56*a* on hand-held power tools 12*a* that are unsuitable for it.

The torsion-prevention unit 38*a* is disposed on the guard hood 16*a* on a side 54*a* of the guard hood neck 104*a* facing away from the receiving region 52*a* in the radial direction 108*a*, and the torsion-prevention unit 38*a* is formed by a form-locking unit 110*a*. The torsion-prevention unit 38*a* has a plurality of torsion-prevention elements 40*a*, 42*a*, disposed in succession in a circumferential direction 44*a*, which are formed by form-locking elements 146*a*, 148*a* and form a set of teeth 46*a*. The form-locking elements 146*a*, 148*a* embodied by teeth extend, together with a guard hood body 112*a* of the guard hood 16*a*, over an angular range of approximately 180° of the tool 18*a* in the circumferential direction 44*a*, so that mounting the guard hood 16*a* in an unprotected position that is dangerous to a user is advantageously prevented. Fundamentally, however, it is also conceivable for the form-locking elements 146*a*, 148*a* to cover an angular range in the circumferential direction 44*a* of nearly 360° on the guard hood neck 104*a*. The teeth extend in the radial direction 108*a* outward from the guard hood neck 104*a*. It is also conceivable for the form-locking elements 146*a*, 148*a* to be formed by recesses, indentations, and/or other form-locking elements 146*a*, 148*a*, disposed in the guard hood neck 104*a*, the form-locking elements being of a kind that would be appropriate to one skilled in the art.

Moreover, between the flange neck 88*a* and the guard hood 16*a* or the guard hood neck 104*a*, a compensation element 118*a* (FIG. 2) is also disposed in the radial direction 108*a*. The compensation element 118*a* is formed from a rubberlike material and embodied cylindrically. The compensation element 118*a* is intended to counteract or prevent play between the flange neck 88*a* and the guard hood neck 104*a*.

In an already-mounted state of the guard hood unit 56*a* on the right-angle power sander 14*a* (FIGS. 1 and 2), the two torsion-prevention units 20*a*, 38*a* are in engagement with one another. In this situation, the form-locking elements 146*a*, 148*a* of the guard hood 16*a*, which are formed by teeth, mesh with a threaded profile of the threaded shaft 32*a*. Rotation of the actuation element 36*a* along with the threaded shaft 32*a* in a direction of rotation 102*a* about the longitudinal axis 22*a* exerts a force 116*a*, because of the set of teeth 28*a*, embodied as a thread, of the threaded shaft 32*a*, along the longitudinal axis 22*a*, on the form-locking elements 146*a*, 148*a*, meshing between the thread, of the guard hood 16*a*, and this force is transmitted via a threaded flank 114*a* to the form-locking elements 146*a*, 148*a* and thus to the guard hood 16*a*. As a result of this force, a rotation of the guard hood 16*a* in the circumferential direction 44*a* from a first guarding position to a second guarding position is effected. A change from one guarding position to a further guarding position of the guard hood can be accomplished in continuously variable fashion here by means of the rolling-contact worm gear 30*a*. Because of self-locking of the rolling-contact worm gear 30*a*, a rotation of the guard hood 16*a* with transmission of linear momentum and/or force from the guard hood 16*a* to the threaded shaft 32*a* is prevented. For that purpose, a pitch of the threaded flank 114*a* of the threaded shaft 32*a* is embodied such that even at extremely strong linear momentums and/or torques, acting on the guard hood 16*a* or on the guard hood torsion preventer 10*a*, as in the case in particular of fragments of a bursting tool 18*a* that strike the guard hood 16*a*, a rotation of the guard hood 16*a* out of the guarding position is prevented.

Alternatively or in addition, in a further embodiment, an adjustment of a guarding position of the guard hood 16*a* can moreover be effected by way of a switching unit which is operable or adjustable by the user and by which a motor for rotating the torsion-prevention unit 20*a* can be controlled. The switch unit may have one control element for coarse positioning and one control element for fine positioning of the guarding position of the guard hood 16*a*.

In FIGS. 4 through 7, alternative exemplary embodiments are shown. Components, characteristics and functions that remain essentially the same are identified by the same reference numerals throughout. However, to distinguish the various exemplary embodiments, the letters a through e are added to the reference numerals in the exemplary embodiments. The ensuing description is limited essentially to the differences from the exemplary embodiment in FIGS. 1 through 3, and the description of the exemplary embodiment of FIGS. 1 through 3 can be referred to for components, characteristics and functions that remain the same.

Figure 4:
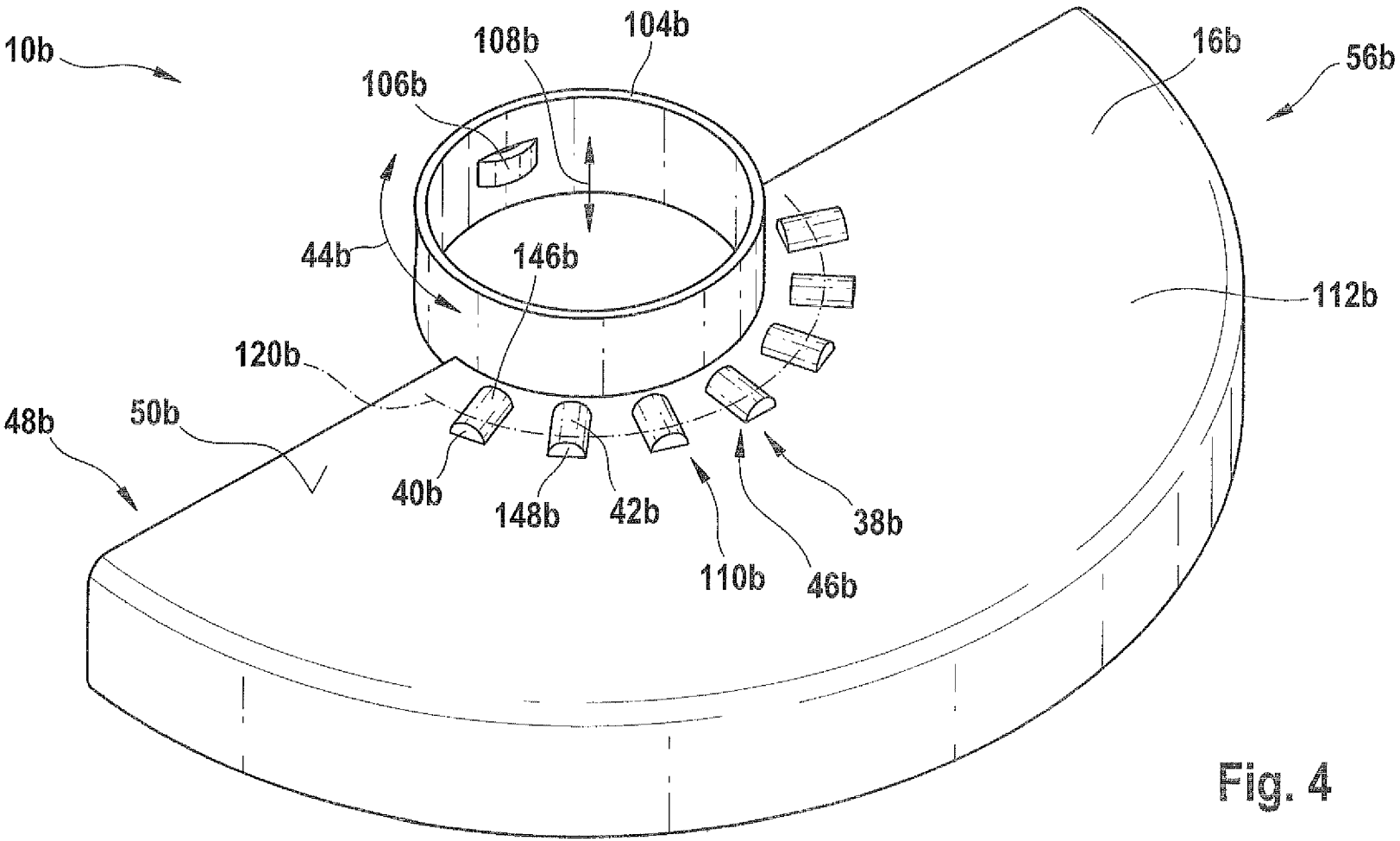
FIG. 4 shows an alternative embodiment to FIG. 3 of a guard hood in a schematic illustration.

In FIG. 4, an alternative embodiment to FIG. 3 of a torsion-prevention unit 38*b* of the guard hood torsion preventer 10*b* is shown. The torsion-prevention unit 38*b* is disposed on a guard hood 16*b* and embodied in one piece with it. Moreover, the torsion-prevention unit 38*b* is formed by a form-locking unit 110*b* and has a plurality of torsion-prevention elements 40*b*, 42*b*, which are formed by form-locking elements 146*b*, 148*b*. The form-locking elements 146*b*, 148*b* are disposed along a semi-circular path 120*b* on a guard hood body 112*b*, on a side 50*b* of the guard hood body 112*b* facing away from a receiving region 48*b* for a tool. The form-locking elements 146*b*, 148*b* are embodied as a set of teeth 46*b*, which extend away from the guard hood body 112*b* in the direction of the side 50*b* facing away from the receiving region 48*b*. A form-locking connection to a further torsion-prevention unit of a guard hood torsion preventer 10*b* is effected analogously to the exemplary embodiment in FIG. 2. Analogously to the exemplary embodiment in FIGS. 1 through 3, here as well the form-locking elements 146*b*, 148*b*, in an alternative embodiment, may be formed by recesses and/or indentations that can be engaged by a set of teeth of a threaded shaft.

Figure 5:
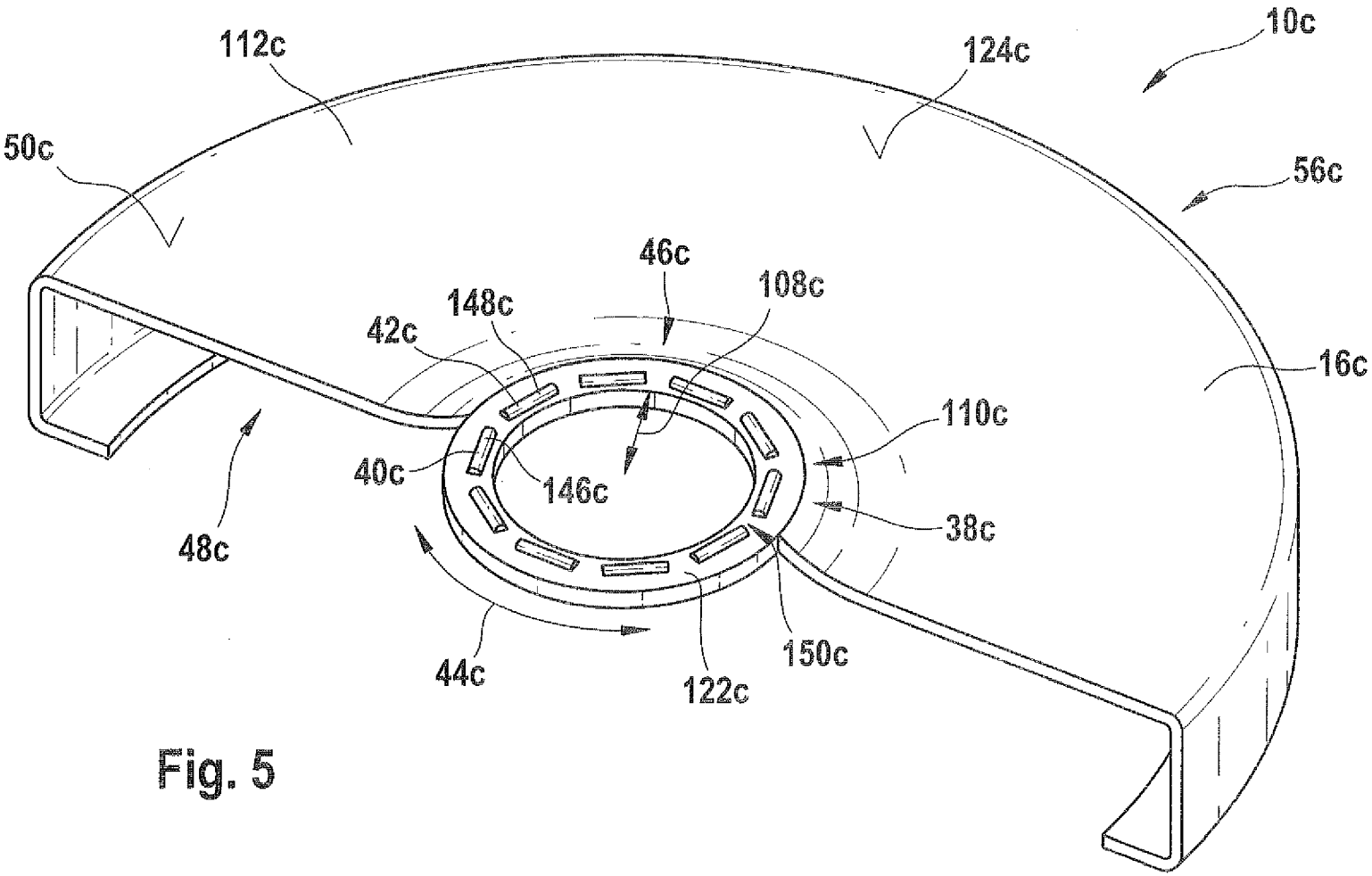
FIG. 5 shows an alternative embodiment to FIG. 3 of a guard hood with a flat collar, in a schematic illustration.

In FIG. 5, a guard hood unit 56*c* that is an alternative to FIGS. 3 and 4 is shown, with a guard hood 16*c*. Instead of a guard hood neck, the guard hood 16*c* has a guard hood collar 122*c*, which extends essentially parallel to an extension face 124*c* of a guard hood body 112*c* of the guard hood 16*c*. The guard hood collar 122*c* is intended for securing the guard hood 16*c* to a receiving unit of a right-angle power sander, and for that purpose, by means of a disk not shown in detail that can be screwed to the receiving unit, it can be clamped between the disk and the receiving unit. For torsion prevention, the guard hood collar 122*c* has a torsion-prevention unit 38*c* of a guard hood torsion preventer 10*c*. The torsion-prevention unit 38*c* has a plurality of torsion-prevention elements 40*c*, 42*c*, which are formed by form-locking elements 146*c*, 148*c*, and the form-locking elements 146*c*, 148*c* are disposed in a radial direction 108*c* outside a clamping region 150*c* for securing the receiving unit to the guard hood collar 122*c*. The form-locking elements 146*c*, 148*c* are disposed in a circumferential direction 44*c* on the guard hood collar 122*c* on a side 50*c* facing away from a receiving region 48*c* for a tool, and they extend away from the guard hood collar 122*c* in the direction of the side 50*c* facing away from the receiving region 48*c*. The form-locking elements 146*c*, 148*c* are formed by a set of teeth 46*c*, analogously to FIGS. 3 and 4. Analogously to the exemplary embodiment in FIGS. 1 through 3, here as well the form-locking elements 146*c*, 148*c*, in an alternative embodiment, may be formed by recesses and/or indentations that can be engaged by a set of teeth of a threaded shaft.

Figure 6:
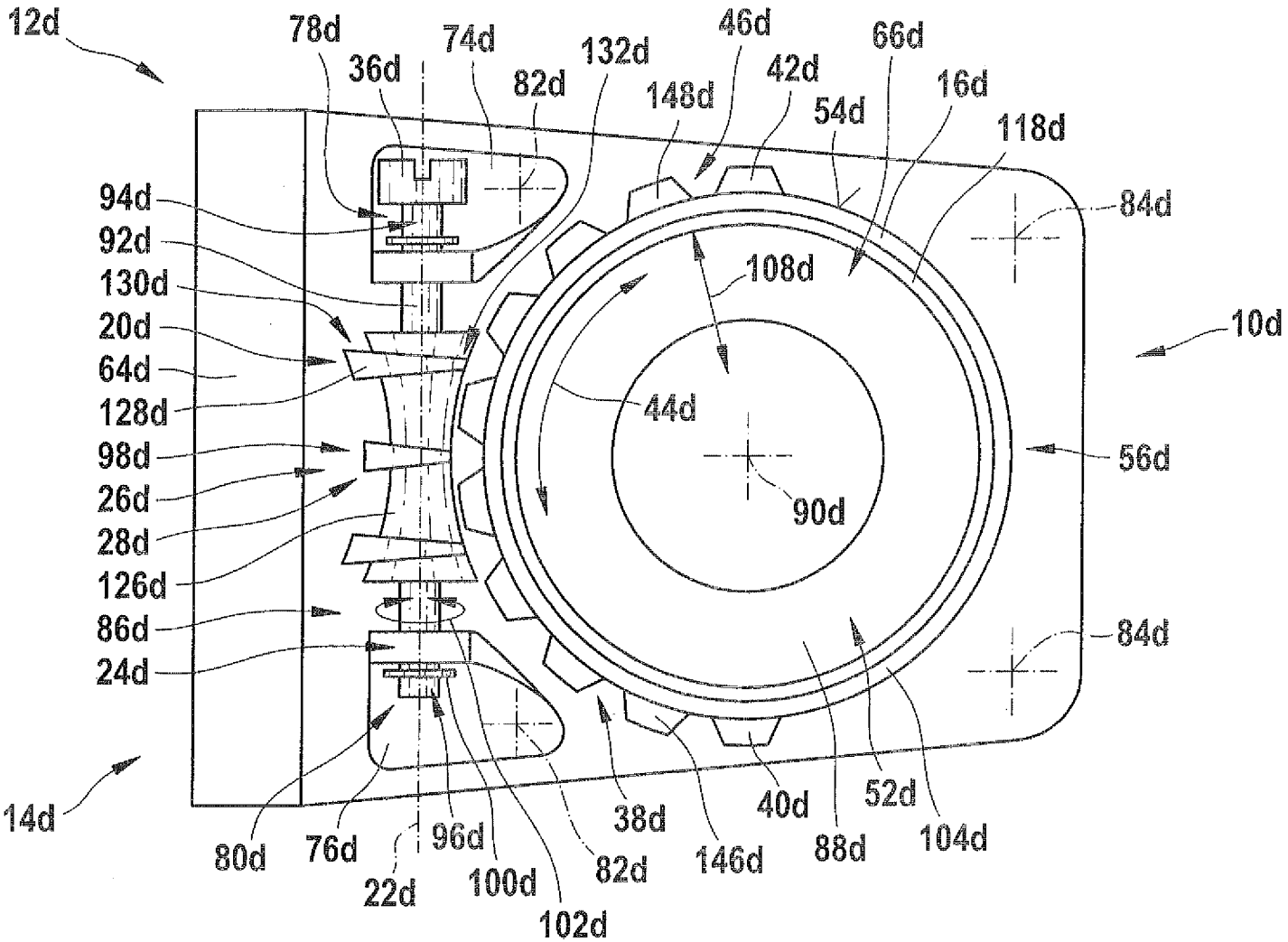
FIG. 6 shows an alternative embodiment to FIG. 2 of the guard hood torsion preventer, with a splined shaft, in a schematic illustration.

In FIG. 6, an embodiment of a torsion-prevention unit 20*d*, as an alternative to FIG. 2, of a guard hood torsion preventer 10*d* is shown. The torsion-prevention unit 20*d* is braced via a bearing point 24*d* on a receiving unit 66*d* for receiving a tool and a guard hood unit 56*d* of a right-angle power sander 14*d*. The torsion-prevention unit 20*d* has a longitudinal axis 22*d*, about which the torsion-prevention unit 20*d* is rotatably supported. The torsion-prevention unit 20*d*, in a middle region 98*d* along the longitudinal axis 22*d*, has a splined shaft 126*d*, which has a set of teeth 28*d* formed by splines 128*d*. The set of teeth 28*d* has three splines 128*d*, extending in the circumferential direction or the direction of rotation 102*d* around the splined shaft 126*d*, and the splines are embodied asymmetrically in the direction of rotation 102*d* of the splined shaft 126*d*, and a portion 130*d* of the set of teeth 28*d* or splines 128*d* in the direction of rotation 102*d* is disposed with a maximum spline height in a radial direction of the splined shaft 126*d*, while another portion 132*d* of the set of teeth 28*d* or of the splines 128*d* is disposed with a /minimum spline height. By a rotation of the torsion-prevention unit 20*d* or of the splined shaft 126*d*, the splines 128*d* engage a set of teeth 46*d* of a torsion-prevention unit 38*d* on a guard hood 16*d*, the torsion-prevention unit 38*d* and the guard hood 16*d* being embodied analogously to the exemplary embodiment in FIG. 3. Alternatively, it is also conceivable for the torsion-prevention unit 38*d* to have torsion-prevention elements 40*d*, 42*d*, formed by recesses, with the splines 128*d* of the splined shaft 126*d*, for torsion prevention or form-locking connection mesh with the torsion-prevention unit 38*d* in indentations intended for the purpose of the torsion-prevention unit 38*d*, which indentations are disposed on a radially outward-oriented surface of the flange neck 88*d*.

By means of the splined shaft 126*d*, the guard hood 16*d* is securely held, as a result of the two meshing torsion-prevention units 20*d*, 38*d* of the guard hood torsion preventer 10*d*, in a guarding position by a spline clamping action between the splined shaft 126*d* and the guard hood 16*d*. By rotation of the splined shaft 126*d* by 180° in the direction of rotation 102*d* about its longitudinal axis 22*d*, a form-locking connection or spline clamping action between the two torsion-prevention units 20*d*, 38*d* is undone, and the guard hood 16*d* can be changed in its position or lifted from the flange neck 88*d* by a user of the right-angle power sander 14*d*. It is moreover conceivable for the splined shaft 126*d* to be prestressed or preclamped in a wedging position by means of a spring element and/or a detent element and/or other components that appear appropriate to one skilled in the art.

Figure 7:
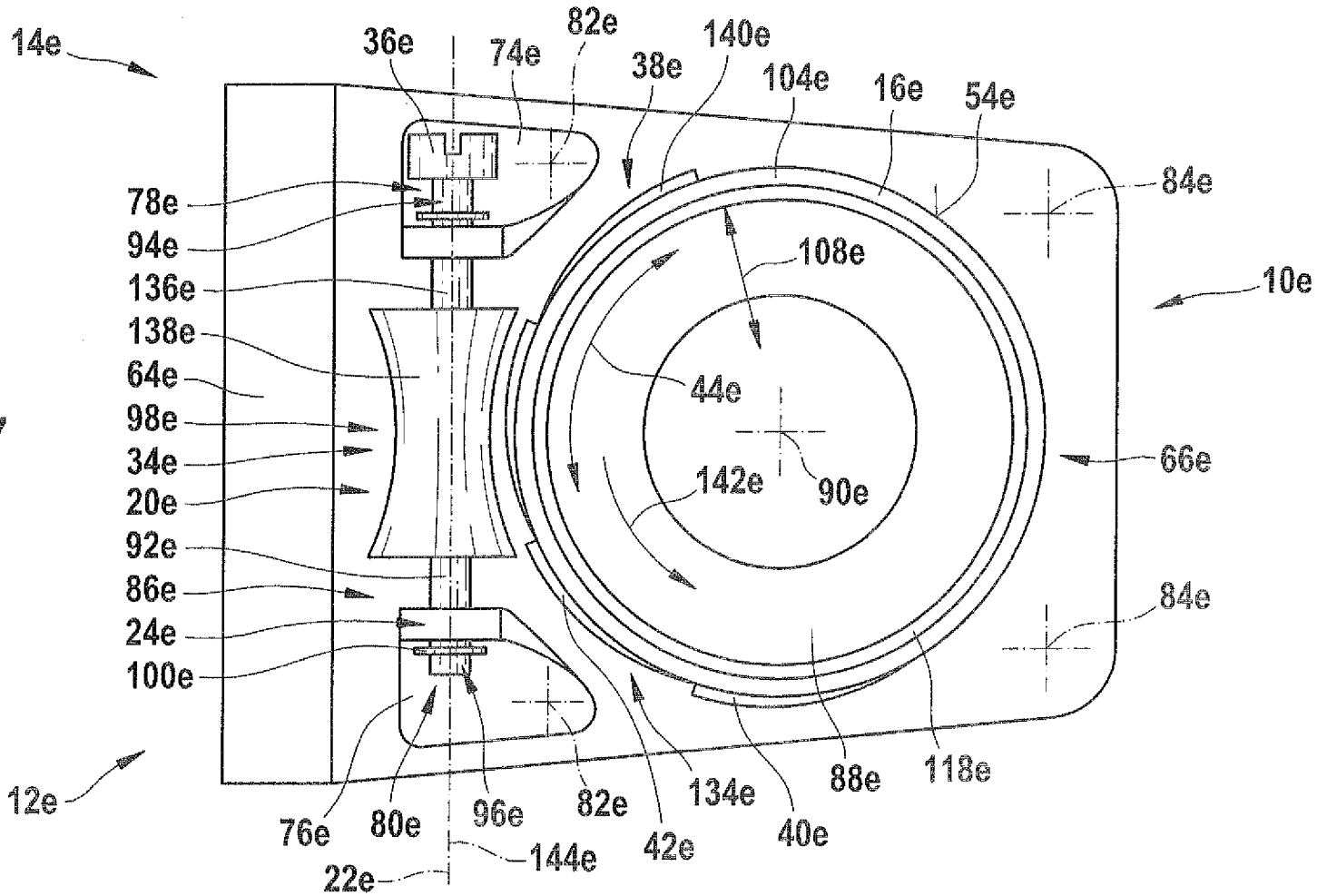
FIG. 7 shows a guard hood torsion preventer with a force-locking unit, in a schematic illustration.

In FIG. 7, an embodiment of a guard hood torsion preventer 10*e* is shown that is an alternative to FIG. 2. The guard hood torsion preventer 10*e* has two torsion-prevention units 20*e*, 38*e*, which are each formed by a respective force-locking unit 34*e*, 134*e*. The first torsion-prevention unit 20*e* is braced via a bearing point 24*e* on a receiving unit 66*e* of a right-angle power sander 14*e*, and the torsion-prevention unit 20*e* is supported rotatably about its longitudinal axis 22*e* in the bearing point 24*e*. The torsion-prevention unit 20*e* has a shaft 92*e*, formed by a force-locking shaft 136*e*, which in its middle region along the longitudinal axis 22*e* has a force-locking element 138*e*, and for attaining a force lock with a guard hood 16*e*, the force-locking element 138*e* is disposed asymmetrically about the longitudinal axis 22*e*, and an axis of rotation 144*e* extends eccentrically through the force-locking element 138*e*. For assuring a force lock, the force-locking shaft 136*e* can be fixed in its position by a user, via fixation elements not shown in further detail. The second torsion-prevention unit 38*e* is embodied in one piece with a guard hood neck 104*e* of the guard hood 16*e*. The torsion-prevention unit 38*e* has torsion-prevention elements 40*e*, 42*e*, disposed in succession in the circumferential direction 44*e* and formed by force-locking elements 140*e*, which are formed by ramps that rise counter to a direction of rotation 142*e* of a tool. In a mounted position or guarding position of the guard hood 16*e* on the right-angle power sander 14*e*, a static friction is operative between the two torsion-prevention units 20*e*, 38*e*, or between the force-locking shaft 136*e* and the ramps of the guard hood 16*e*, and this friction counteracts rotation of the guard hood 16*e* out of the guarding position. Moreover, by means of the ramps, a static friction force between the ramps and the force-locking shaft 136*e* upon a rotation of the guard hood 16*e* in the direction of rotation 142*e* is additionally increased, so that even at strong rotary linear momentums and/or torques, as in the case for instance of tool fragments, spun outward and striking the guard hood 16*e*, from a tool that has burst in operation of the right-angle power sander 14*e*, rotation of the guard hood 16*e* out of its guarding position is advantageously prevented.

The foregoing relates to preferred exemplary embodiments of the invention, it being understood that other variants and embodiments thereof are possible within the spirit and scope of the invention, the latter being defined by the appended claims.

I claim:

1. A guard hood torsion preventer for a handheld power tool, comprising:

a guard hood mounted on the handheld power tool in a manner so as to partially cover a tool of the handheld power tool, the guard hood defining a first longitudinal axis; and at least one torsion-prevention unit defining a second longitudinal axis about which the torsion-prevention unit is rotatably supported, wherein the at least one torsion-prevention unit is configured to rotate about the second longitudinal axis and is formed at least partly by a form-locking unit, and wherein rotation of the at least one torsion-prevention unit about the second longitudinal axis causes a portion of the at least one torsion-prevention unit configured to urge against an adjacent portion of the guard hood to rotate the guard hood about the first longitudinal axis, the portion of the at least one torsion-prevention unit configured to remain in continuous engagement with the adjacent portion of the guard hood from any starting position and for any positive or negative rotation of the at least one torsion-prevention unit about the second longitudinal axis, the interaction of the portion of the at least one torsion-prevention unit and the adjacent portion of the guard hood resisting rotation of the guard hood when the guard hood is acted upon by an external force.

2. The guard hood torsion preventer as defined by claim 1, further having at least one bearing point, through which the torsion-prevention unit is braced on the handheld power tool.

3. The guard hood torsion preventer as defined by claim 1, wherein the portion of the at least one torsion-prevention unit is embodied as a shaft.

4. The guard hood torsion preventer as defined by claim 2, wherein the portion of the at least one torsion-prevention unit is embodied as a shaft.

5. The guard hood torsion preventer as defined by claim 1, wherein the torsion-prevention unit has at least one actuation element, which rotates the torsion-prevention unit about the second longitudinal axis.

6. The guard hood torsion preventer as defined by claim 2, wherein the torsion-prevention unit has at least one actuation element, which rotates the torsion-prevention unit about the second longitudinal axis.

7. The guard hood torsion preventer as defined by claim 3, wherein the torsion-prevention unit has at least one actuation element, which rotates the torsion-prevention unit about the second longitudinal axis.

8. The guard hood torsion preventer as defined by claim 1, wherein the torsion-prevention unit is formed at least partly by a form-locking unit.

9. The guard hood torsion preventer as defined by claim 8, wherein the portion of the at least one torsion-prevention unit is embodied as a threaded portion of a shaft.

10. The guard hood torsion preventer as defined by claim 1, wherein the adjacent portion of the guard hood has at least two torsion-prevention elements disposed in succession in a circumferential direction on the guard hood.

11. The guard hood torsion preventer as defined by claim 10, wherein the at least two torsion-prevention elements includes at least two teeth.

12. The guard hood torsion preventer as defined by claim 10, wherein the adjacent portion is disposed at least partly on a side of the guard hood facing away from a receiving region of the guard hood for the tool.

13. The guard hood torsion preventer as defined by claim 11, wherein the adjacent portion is disposed at least partly on a side of the guard hood facing away from a receiving region of the guard hood for the tool.

14. A guard hood torsion preventer for a handheld power tool, comprising:

a guard hood mounted on the handheld power tool in a manner so as to partially cover a tool of the handheld power tool, the guard hood defining a first longitudinal axis; and at least one torsion-prevention unit defining a second longitudinal axis about which the torsion-prevention unit is rotatably supported, wherein the at least one torsion-prevention unit is configured to rotate about the second longitudinal axis, wherein the torsion-prevention unit is formed at least partly by a form-locking unit embodied as a rolling-contact worm gear, and wherein the guard hood has a corresponding locking portion configured for continuous engagement with the worm gear, the interaction of the portion of the guard hood and the worm gear resisting rotation of the guard hood when the guard hood is acted upon by an external force.

15. A guard hood torsion preventer for a handheld power tool, comprising:

a guard hood mounted on the handheld power tool in a manner so as to partially cover a tool of the handheld power tool, the guard hood defining a first longitudinal axis; and at least one torsion-prevention unit defining a second longitudinal axis about which the torsion-prevention unit is rotatably supported, wherein the at least one torsion-prevention unit is configured to rotate about the second longitudinal axis, wherein rotation of the at least one torsion-prevention unit about the second longitudinal axis causes rotation of the guard hood about the first longitudinal axis, wherein the at least one torsion-prevention unit includes a shaft that defines the second longitudinal axis, wherein the shaft includes a threaded portion and rotation of the torsion-prevention unit causes rotation of the threaded portion, and wherein the guard hood includes a plurality of teeth that meshingly engage the threaded portion, the interaction of the threaded portion and the plurality of teeth resisting rotation of the guard hood when the guard hood is acted upon by an external force.

16. The guard hood torsion preventer as defined by claim 15, wherein rotation of the threaded portion causes rotation of the plurality of teeth.

* * * * *